US005770961A

United States Patent [19]

Pontiff

[11] Patent Number: 5,770,961

[45] Date of Patent: Jun. 23, 1998

[54] UNIVERSAL ACOUSTIC POWER AMPLIFIER

[75] Inventor: Martin L. Pontiff, New Iberia, La.

[73] Assignee: ESSI Corporation, Broussard, La.

[21] Appl. No.: 664,314

[22] Filed: Jun. 7, 1996

[51] Int. Cl.[6] ..... H03B 19/00

[52] U.S. Cl. ..... 327/306; 327/114; 327/172; 327/175; 327/355

[58] Field of Search ..... 327/113, 114, 327/165, 172, 175, 306, 308, 355, 361

[56] References Cited

U.S. PATENT DOCUMENTS

| | | | |
|---|---|---|---|
| 3,473,084 | 10/1969 | Dodge . | |
| 3,541,388 | 11/1970 | Dodge et al. . | |
| 3,701,026 | 10/1972 | Gutleber | 327/355 |
| 3,870,963 | 3/1975 | Groce et al. | 327/114 |
| 4,595,978 | 6/1986 | Sheffield . | |
| 4,689,609 | 8/1987 | Ko et al. . | |
| 4,754,416 | 6/1988 | Adams et al. . | |
| 5,136,192 | 8/1992 | Kooijman | 327/335 |
| 5,291,081 | 3/1994 | Takeuchi et al. | 327/113 |
| 5,502,411 | 3/1996 | Matsuki et al. | 327/113 |
| 5,661,424 | 8/1997 | Tang | 327/355 |

*Primary Examiner*—Terry Cunningham
*Attorney, Agent, or Firm*—Robert N. Montgomery

[57] ABSTRACT

Disclosed are method and apparatus for producing electric waveform driver signals for exciting acoustic emitters such as foghorns, wherein the frequency and amplitude of the signals are readily variable to match the input requirements of the respective drivers of the acoustic devices. In disclosed embodiments of a signal generator according to the present invention a coupling circuit outputs the driver signal through an array of field-effect transistors.

35 Claims, 4 Drawing Sheets

10
E
14
40
dc/dc
F
42
18
26
DELAY
28
24
TIMING
22
VR
30
A
COUPLER
G
38
AMP
D
POWER SENTRY
32
C
34
GEN
B
16
36
12
20

GENERATOR
DELAY
TIMING
XTAL
INVERT
VR
SENTRY
dc/dc
+5Vdc
GND
+12Vdc
+45Vdc
A
B
C
D
E
F
G
D'
D''
18
14
32
34
38
50
52
54
56
58
60
62
64
66
68
70
72
74
76
78
80
82
84
86
88
90
92
94
96
98
100
102
104
106
108
110
112
114
116
118
120
122
124 f
140
142
146
MASTER
DELAY
138
144
C'
148
A
SENTRY-
BUFFER
D
B
CHARGE
PUMP
DRIVER
150
D'
D''
FETs
X
4
G-TO
DRIVERS
152
154
F
VR
136
E
dc/dc
130
132
134

UNIVERSAL ACOUSTIC POWER AMPLIFIER

BACKGROUND OF THE INVENTION

1. Field of the Invention

The present invention pertains to electrical wave generators for powering loudspeaker drivers and the like. More particularly, the present invention relates to waveform generators and power amplifiers for producing electrical signals for powering loudspeaker drivers to emit acoustic signals, and finds particular application to powering acoustic warning devices such as foghorns, for example.

2. Description of Prior Art

Acoustic signaling devices are used as marine navigational aides and warning devices. A foghorn, or an array of foghorns, is located and oriented to communicate acoustic warning signals in selected directions, for example, using recognized signal patterns. For example, the United States timing code of a steady sound for two seconds followed by silence for eighteen seconds, and the International Morse "U" code are two recognized and accepted signals for maritime navigational uses. Such pulsed signals may be produced by various loudspeaker systems, or sound emitters, approved by the United States Coast Guard, for example. Each such acoustic device includes a driver for producing acoustic waves, with the driver receiving an electric waveform signal. In general, the acoustic emitters are tuned to specific frequencies by their respective size and shape, for example. Further, the drivers of the emitters operate at specific input power levels. Additionally, a typical available signal generator is coupled to a foghorn driver directly through a transformer that steps up the signal amplitude, and also presents a critical impedance matching requirement for input to the driver. Consequently, an electrical signal generator must be selected to match the input requirements of the respective foghorn or other sound emitting device to be operated by the signal generator.

It is therefore desirable and advantageous, and an object of the present invention, to provide a waveform generator whose output signal can be readily varied in frequency and power level to meet the requirements of the acoustic sound emitter driver the generator is to excite. It is also an object of the present invention to provide an electrical signal generator circuit that avoids presenting significant impedance mismatches with a variety of acoustic devices. It is a further object of the present invention to provide a signal generator for exciting drivers of foghorns and the like at various acoustical frequencies that are readily selected, and according to readily selected duty cycles, or timing codes, for example. A signal generator according to the present invention, exhibiting these features, is a universal power amplifier, or signal generator, capable of operating virtually any acoustic signal device, as opposed to presently available generators which must be matched to specific signal devices.

SUMMARY OF THE INVENTION

The present invention provides an electrical signal generator that produces an output driver signal with a waveform having a selected frequency and a selected amplitude for driving acoustic emitter devices such as foghorns. Both the output signal frequency and the output signal amplitude are readily variable to match the input requirements of any acoustic emitter device. Further, the circuitry of the present invention is readily coupled to any such foghorn driver, for example, without significant impedance mismatch. Accordingly, a signal generator of the present invention comprises a universal acoustic power amplifier that generates selectively amplified driver signals.

A signal generator according to the present invention comprises a timing circuit that produces a duty cycle signal wherein the duty cycle is defined by the pulse pattern of the signal. Delay circuitry may be provided for selectively interrupting the pulse pattern of the duty cycle signal so that no pulses appear during a selected delay period. A power sentry circuit receives the duty cycle signal and provides a pulsed power signal including a voltage level for operating other circuits of the signal generator during pulses of the duty cycle signal.

In one form of the invention a waveform generator circuit receives and is operated by the pulsed power signal to produce a waveform signal during pulses of the duty cycle signal. Variable frequency selecting circuitry as part of the waveform generator circuit allows the frequency of the waveform signal to be readily selected and varied. A signal driver circuit, operated by the pulsed power signal, may receive the waveform signal and amplify that signal during pulses of the duty cycle signal.

In another form of the invention a waveform generator circuitry, with variable frequency selecting circuitry, is provided with the timing circuit to produce a waveform signal that is not pulsed. The waveform signal is pulsed by the power sentry circuit.

A voltage source circuit receives the pulsed power signal and provides a voltage level output signal during pulses of the duty cycle signal. Variable voltage level selecting circuitry as part of the voltage source circuit allows the voltage level of the voltage level output signal to be readily selected and varied.

A switching coupler circuit receives the voltage level output signal and the waveform signal, and, during pulses of the duty cycle signal, provides an output driver signal having a waveform of the frequency of the waveform signal from the waveform generator circuit, and an amplitude determined by the voltage source circuit.

The timing circuit, the power sentry circuit, the waveform generator circuit and the signal driver circuit may comprise integrated circuits. The voltage source circuit may comprise a dc/dc converter.

The coupler circuit receives the waveform signal, and divides and shapes that signal. A shaped waveform and an inverted shaped waveform are thus produced from the waveform signal input to the coupler circuit, with one such shaped signal being input to a pair of field-effect transistors while the other, inverted, such shaped signal is input to a second pair of field-effect transistors, to produce the output waveform driver signal across the two pairs of field-effect transistors. The coupler circuit may divide the waveform signal input to the coupler circuit using an array of transformers, for example, and may shape the resulting waveform signals using Zener diodes. Alternatively, an integrated circuit charge pump driver may be used to divide and shape the waveform signal input to the coupler circuit.

In a method of the invention a duty cycle signal is provided, with the duty cycle defined by pulses in the signal. A pulsed power signal is produced according to the pulse pattern of the duty cycle signal, and is used to perform other steps in the method. A waveform signal of selected frequency is produced, and divided and shaped, then applied to a pair of field-effect transistors while an inversion of the shaped waveform is applied to another pair of field-effect transistors. An output waveform signal of the selected frequency is provided across the two pairs of field-effect transistors to the external drivers, or speakers. A voltage output level signal with selected voltage level is produced to determine the amplitude of the output waveform signal.

A signal generator according to the present invention saves energy by operating various circuits thereof only during pulses of the duty cycle signal, and further employs integrated circuits to minimize size and energy consumption.

DESCRIPTION OF PREFERRED EMBODIMENTS

Figure 1:
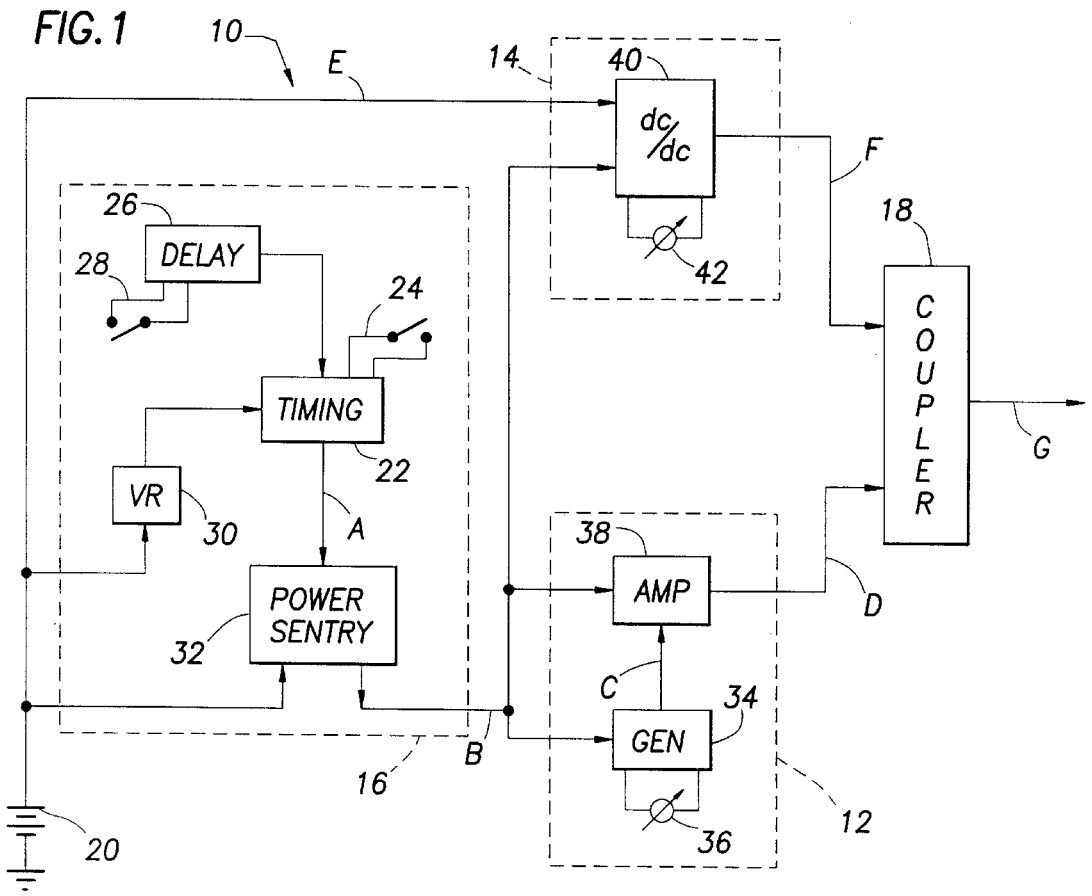
FIG. 1 is a block diagram of a signal generator, or universal acoustic power amplifier, according to the present invention.

A signal generator, or universal acoustic power amplifier, according to the present invention is shown in block form generally at 10 in FIG. 1. In general, the signal generator 10 may be considered to include four sections based on the functions of the respective sections, and each of the first three of these sections is shown contained within a separate, numbered, dashed-line perimeter in FIG. 1. An acoustic signal source 12 provides an amplified, electrical sine wave of a selected frequency in the acoustical range, with the frequency determined for the particular application of the power amplifier 10. A voltage source 14 provides a dc voltage level output signal, also selected based on the requirements of the particular application of the power amplifier 10. A timer section 16 determines a duty cycle which controls the time during which the acoustic signal source 12 so produces its sine wave output signal, and the time during which the voltage source 14 so provides its output voltage level. The selected voltage level output from the voltage source 14 and the acoustic frequency signal from the acoustic signal source 12 are received by a switching coupler, or coupler circuit, 18, which shapes the sine wave, or chops it, to produce a driver signal of the selected frequency and of an amplitude determined by the voltage level. The driver signal produced by the coupler 18 is delivered to one or more sound emitter drivers (not shown), such as loudspeaker drivers. A dc power source 20, such as a bank of batteries in parallel, provides power to operate all of the components of the power amplifier 10 and to ultimately provide the voltage for the output signal from the switching coupler 18.

The timer section 16 includes a timing circuit 22, which provides a duty cycle control signal A generally comprising a cyclic series of pulses capable of driving a gate. The timing circuit 22 may comprise an integrated circuit with coding provided by external switching, symbolically indicated at 24. For example, the switching 24 may be set to cause the timing circuit 22 to produce pulses that are two seconds in length, separated by eighteen seconds of down time. This pattern of two seconds on and eighteen seconds off is a U.S. standard duty cycle for foghorns used as marine navigational aids and warning signal devices. The switch 24 may also be set to cycle the timing circuit 22 according to the International Morse "U" code, or in some other selected signal pattern. The control signal A determines the duty cycle of the output signals of the acoustic signal source 12 and of the voltage source 14, and therefore of the output coupler 18, based on settings determined by the condition of the coding switching 24 connected to appropriate input leads to the timing circuit 22.

The timing section 16 may also include a delay circuit 26, which may be included in the integrated circuit providing the timing circuit 22, for example, for effectively turning off the timing circuit for a selected time period, and so affecting the duty cycle determined by the timing circuit. For example, the delay circuit 26 may be activated to prevent the production of pulses in the output control signal A by the timing circuit 22 for two hours to allow servicing of the power amplifier 10 or other, associated equipment at the same site, particularly in the case of an application to drive a foghorn. The two hour time delay, during which the foghorn remains silent, allows time for maintenance personnel to enter the vicinity of the foghorn, perform service tasks, and leave the vicinity of the foghorn without being subjected to the loud volume of the foghorn at close range. An activation switch 28 may be used to selectively activate the delay circuit 26. The switch 28 may be removed some distance from the amplifier 10 and the associated foghorn, or may be remotely controlled as by radio or telephone, for example, to so interrupt the duty cycle of the power amplifier 10 to allow a work crew to approach the area with the foghorn already shut down.

The timing circuit 22 receives operating power from the dc power source 20 through a voltage regulator 30, which provides a well regulated voltage signal, stepped down from the input voltage from the source 20 as needed for the specifications of the timing circuit. For example, if the source 20 provides a twelve volt output, the voltage regulator 30 may step that signal down to five volts output to the timing circuit 22.

The pulsed duty cycle signal A output from the timing circuit 22 is received by a power sentry 32, which is also powered by the power source 20. The power sentry 32 is a control device which allows operating power to advance from the power source 20 to the acoustic signal source 12 and to the voltage source 14 in an operational power signal B, only in accordance with a control signal received by the power sentry. In this case, the duty cycle signal A, output from the timing circuit 22, serves as the control signal to operate the power sentry 32. Operating power is received by the acoustic signal source 12 and by the voltage source 14 only during the "on" pulses produced in the output signal A of the timing circuit 22, and not during the down period between pulses in that output signal, including any down time dictated by the delay circuit 26. The amplitude of the pulsed, power signal B output by the power sentry 32 is the same as the voltage level delivered to the power sentry from the power source 20, and is greater than the amplitude of the control signal A.

The acoustic signal source 12 includes a waveform generator 34 that produces sine wave electrical signals C in the acoustic frequency range, for example. The waveform generator 34 is a variable frequency oscillator, with a frequency adjust, or variable frequency selecting circuit, 36. The signal frequency selected by the frequency adjust 36 and produced by the generator 34 is the frequency of the sound to be produced by the loudspeaker whose driver is to receive the output signal from the switching coupler 18. The signal frequencies available for production by the generator 34 may include a continuous spectrum of frequencies over some band in the acoustic frequency range, or the generator and the frequency adjust 36 may provide only discrete frequency choices. The generator 34 may include an integrated circuit with the frequency adjust 36 in the form of external switches that are set to code in the desired frequency selection for the output wave C.

The generator 34 is powered by the pulsed power signal B from the power sentry 32, and therefore produces a sine wave output signal C only during the "on" pulses of the control signal A output by the timing circuit 22, which controls the power signal output from the power sentry. The waveform signal C from the waveform generator 34 is thus in the form of a sine wave of the selected frequency, within an envelope of pulses whose timing and duration are the same as those of the pulses in the control signal A output from the timing circuit 22.

The acoustic signal source 12 also includes a signal driver, or amplifier, 38 that receives the signal C output from the waveform generator 34, and amplifies this signal to produce an amplified, pulsed, sine wave signal D that is delivered to the switching coupler 18. The pulsed, power signal B output from the power sentry 32 also operates the signal amplifier 38, according to the same duty cycle determined by the control signal A from the timing circuit 22.

The voltage source 14 includes a dc/dc voltage converter 40 which receives a constant value dc voltage E directly from the power source 20, for example, and produces an output voltage level F which is of the same value as the input signal E, or is stepped up or down from the value of E as required by the specifications of the loudspeaker whose driver is to receive the output signal from the switching coupler 18. The voltage source 14 also includes a voltage adjust, or variable voltage level selecting circuit, 42 for selectively setting the conversion operation of the dc/dc converter 40 to produce the desired output voltage level F from the input voltage level E. The dc/dc converter 40 may include an integrated circuit, with the voltage adjust 42 in the form of an external variable resistor that may be set to code in the appropriate voltage level conversion to obtain the desired voltage output F.

While the dc/dc converter 40 selectively steps up or steps down the voltage E from the power source 20 to produce the output voltage level F, the pulsed, power signal B from the power sentry 32 operates the dc/dc converter to carry out this stepping function. The converter 40 therefore produces an output voltage level F during the "on" portions of the duty cycle determined by the control signal A from the timing circuit 22; otherwise, the output voltage level from the converter is zero, or possibly some non-zero bias value.

The switching coupler 18 utilizes the voltage level F from the dc/dc converter 40 in forming a driver output signal G from the sine wave signal D, and serves to couple the signal G to loudspeaker drivers, for example.

Figure 2:
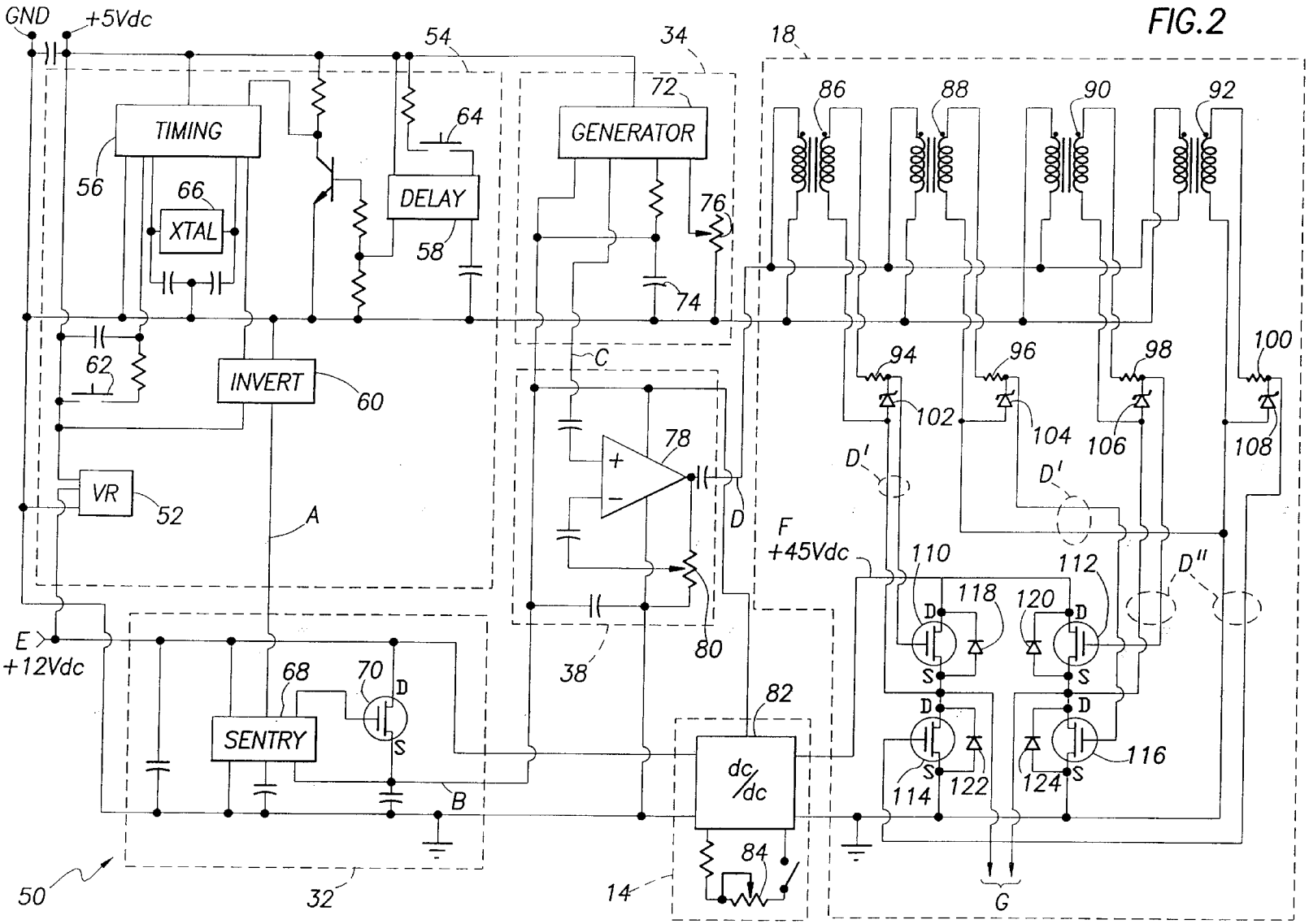
FIG. 2 is a schematic diagram of the electronic circuitry of one embodiment of the universal acoustic power amplifier illustrated in FIG. 1.

A schematic diagram of one embodiment of the signal generator, or power amplifier, according to the present invention is shown generally at 50 in FIG. 2 wherein various sections of the generator circuit are delineated by dashed-line perimeters.

Power is input to the power amplifier 50 in FIG. 2 from an external dc power source (not shown) at an appropriate voltage level E for the particular application of the power amplifier, for example. For purposes of illustration rather than limitation, consider that the dc voltage level E of the power input to the power amplifier 50 is twelve volts as indicated in the diagram. In FIG. 2 a voltage regulator 52 steps down the input voltage to five volts as indicated, and provides a regulated five volts dc to timing and delay circuitry 54, while the twelve volt dc input voltage level E is delivered to the power sentry 32. The timing and delay circuitry 54 is shown to include three integrated circuits 56, 58, and 60, dedicated to specific functions; however, any two or all three of these integrated circuits may be provided by a single integrated circuit.

The integrated circuit 56 is an EPROM that determines the duty cycle of the amplifier 50. The circuit 56 can be coded to provide either one of two standard foghorn signal patterns, for example, including the International Morse "U" code signal pattern and the U.S. standard "two seconds on and eighteen seconds off" signal pattern described above. The timing circuit 56 is selectively switched between the two signal patterns by a pulse of five volts dc applied by momentarily closing a no-push, or bounceless, switch 62. A time delay may also be contained in the EPROM 56 to selectively turn off the pulses produced by that integrated circuit for a selected time period, as noted above. The delay program is triggered by a signal from the integrated circuit 58. The triggering signal from the delay circuit 58 is initiated by momentarily grounding one point in that circuit by closing a second no-push, or bounceless, switch 64. A crystal 66 is provided to set the frequency for the timing circuitry in the timing EPROM 56.

Figure 3:
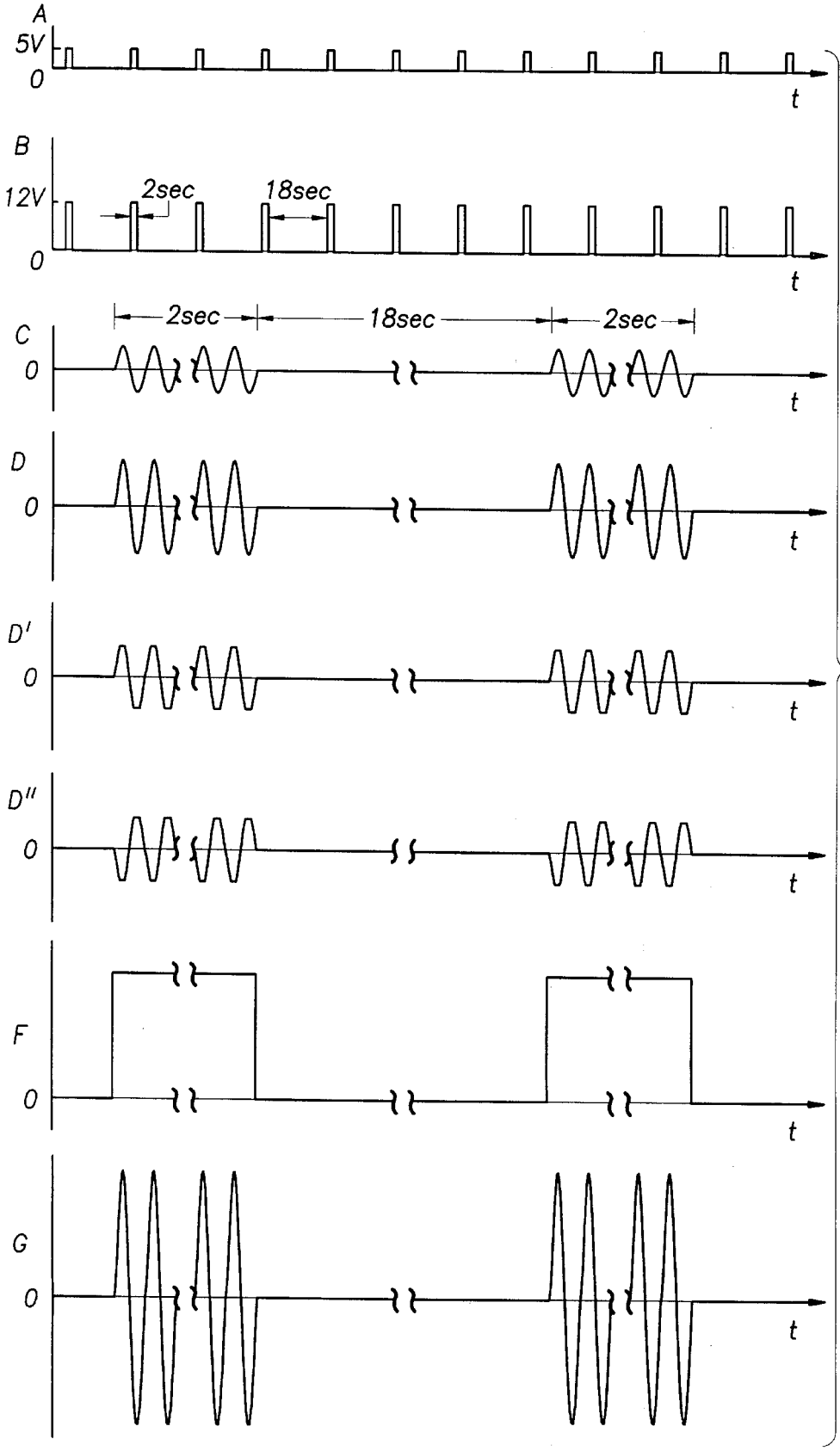
FIG. 3 is a timing plot of signals at various locations in the universal acoustic power amplifier of FIGS. 1 and 2.

The output signal produced by the timing EPROM 56 is a train of pulses of five volt magnitude, going from five volts to zero volts during the "on" periods, with the signal level at five volts during the "off" periods. This output signal is delivered to another EPROM circuit 60 that inverts the signal to a train of positive-going pulses of the same five volt magnitude, with each "on" pulse at five volts and the signal level at zero volts during the "off" periods, and which is the duty cycle signal A delivered to the power sentry 32 in FIG. 2. The signal A is illustrated in FIG. 3 for several cycles of the two seconds on/eighteen seconds off pattern discussed above.

The EPROM 56 of the timing circuitry 54 sets the duty cycle signal A, which is input to the power sentry 32, wherein the pulses of the signal A are effectively stepped up to twelve volts amplitude, as determined by the twelve volt power input E to the amplifier 50. In the power sentry 32 a sentry driver circuit 68 serves as a driver for a field-effect transistor (FET) 70. The sentry driver circuit 68 receives and delivers the five volt pulsed duty cycle signal A to the gate of the FET 70. The twelve volt dc input power level E from the power source is delivered to the drain of the FET 70. Between positive pulses applied to the gate of the FET 70, that is, during "off" periods in the duty cycle signal A, no current flows between the drain and the source of the FET, and that source is at zero volts. With a five volt positive pulse applied to the FET gate, that is, during an "on" period in the duty cycle, current flows between the source and the drain to produce a twelve volt pulse in the output signal B of the power sentry. The power signal B thus produced is in the form of a train of positive voltage level pulses that have the same timing pattern as the signal A from the timing and delay circuitry 54, and which are twelve volts high, as illustrated in FIG. 3.

The pulsed, power signal B is communicated to inputs to an integrated circuit generator 72 in the waveform generator 34 of the acoustic signal source (12 in FIG. 1). The power signal B operates the generator circuit 70 to produce an ac waveform signal during pulses of the duty cycle signal A. An external tuning circuit comprising a capacitor 74 and variable resistance 76 sets the frequency of the sine wave generated by the circuit 72; the variable resistor 76 is adjustable to select the frequency accordingly. The output signal C produced by the waveform generator 34 is a sinusoidal wave of a selected frequency in the acoustical frequency range, within a pulse envelope determined by the duty cycle signal A, with a typical signal C illustrated in FIG. 3.

The output waveform signal C from the wave generator 34 is communicated to the non-inverting input of a balanced differential operational amplifier comprising an integrated circuit 78 in the signal driver 38. Operational power is supplied to the circuit 78 by the pulsed, twelve-volt power signal B from the power sentry 32 so that the circuit 78 produces an output signal only during pulses of the power signal. The external feedback loop from the output of the amplifier circuit 78 to the inverting input of the circuit includes a variable resistor 80, used to selectively adjust the gain of the amplifier. The operational amplifier 78 provides a flat frequency response for high fidelity signal amplification of the waveform C. The output signal D from the signal driver 38 is thus an amplified, modified sine wave of the frequency selected by adjustment of the resistor 76, at a gain selected by adjustment of the resistor 80, and in an envelope of positive pulses whose timing pattern is determined ultimately by the timing pattern of the positive pulses in the duty cycle signal A, as illustrate in FIG. 3.

Power is input to a dc/dc converter 82 of the voltage source 14 from the external power source E. The operational power signal B from the power sentry 32 controls the operation of the dc/dc converter 82 according to the duty cycle determined by the duty cycle signal A. Consequently, the dc/dc converter is "on," and produces an output, only during the "on" times of the duty cycle signal A.

The dc/dc converter in 82 may comprise an operational-amplifier voltage-to-voltage amplifier, and features an external voltage adjust, or gain control circuit, including a variable resistor 84. Adjustment of the resistor 84 determines the voltage level output signal F as stepped up or stepped down from the voltage of the input power E. As illustrated, for example, the input power E from the external power source is twelve volts dc, and the output signal F is a pulsed power signal with maximum voltage at forty-five volts dc, and with the pulses displaying the same timing pattern as the pulses of the duty cycle signal A, as shown in FIG. 3.

The switching coupler 18 comprises a signal divider that divides and shapes the waveform D into two signals D' and D" as follows. The amplified waveform signal D from the signal driver 38 is applied in the switching coupler 18 across the primary coils of four transformers 86, 88, 90, and 92, with the primary coils arranged in parallel. As shown in FIG. 2, the input connections to the primary coils of the transformers 90 and 92 are reversed from the input connections to the transformers 86 and 88. Therefore, the ac wave signals output from 90 and 92 are inverted compared to the ac signals output from 86 and 88. The secondary coils of the transformers 86–92 are connected to resistors 94, 96, 98, and 100, respectively, and Zener diodes 102, 104, 106, and 108 are placed across the secondary coils 86–92, respectively. The modified sine wave output from each of the secondary coils of 86 and 88 is clipped by the respective diode and resistor combination to provide a waveform D' that is a square wave, or at least approximates a square wave, as indicated in FIG. 3, for example. The modified sine wave output from each of the secondary coils of 90 and 92 is also clipped by the respective diode and resistor combination to provide a waveform D" that is a square wave, or approximates a square wave, and is the inverse of the wave D', again, as illustrated in FIG. 3. The signals D' and D" are therefore square waves at the frequency determined by the frequency adjust 76 of the waveform generator 34, and at an amplitude limited by the diode and resistor across the respective transformer secondary.

The secondary coil of each transformer 86–92 is also connected across a respective power FET in an array of four FETs 110, 112, 114, and 116. Thus, the secondary of the transformer 86 is connected between the gate and the source of the FET 110, and the secondary of the transformer 90 is connected between the gate and the source of the FET 112. Diodes 118 and 120 are connected across FETs 110 and 112, respectively. Similarly, the secondary of the transformer 92 is connected between the gate and the source of the FET 114, and the secondary of the transformer 88 is connected between the gate and the source of the FET 116. Diodes 122 and 124 are connected across FETs 114 and 116, respectively. The pulsed power signal F from the dc/dc converter 82 is connected to the drains of FETs 110 and 112. The sources of FETs 114 and 116 are grounded. The source of FET 110 and the drain of FET 114 are connected together, and the source of FET 112 and the drain of FET 116 are connected together.

The output signal G from the switching coupler 18 in particular, and from the power amplifier 50 in general, is taken between the connected source of FET 110 and the drain of FET 114, and the connected source of FET 112 and the drain of FET 116 to be communicated to the driver of the application sound emitter (not shown). This signal G is provided by the operation of the FETs 110–116 acting in the fashion of a double-pole, double-throw switch. A waveform signal is constructed between the connected source of FET 110 and the drain of FET 114, and the connected source of FET 112 and the drain of FET 116, that is, across the array 110–116, only during a non-zero pulse value in the duty cycle signal A. Only during such non-zero values in the signal A is the output voltage signal F of the dc/c converter 82 non-zero, and there exists a waveform in the signal D, and therefore in the signals D' and D". Within the time period of such a non-zero pulse in the duty cycle A, the output signal G from the switching coupler 18 is constructed as follows.

Within the time period of a positive pulse in the duty cycle signal A the waveform D' is applied across FET 110 and FET 116, and the inverse waveform D" is applied across FET 112 and across FET 114. Thus, when a positive acoustic frequency pulse in the signal D' is present across FET 110 and across FET 116, current flows through each of these FETs to produce a pulse between the source of FET 110 and the drain of FET 116, that is, in the signal G, and, at the same time, a negative pulse in the signal D", which is the inverse of the pulse in the signal D', is applied across FET 112 and across FET 114 so that no current flows through these FETs. In the second half of the cycle of the waveform of the signal D', the pulse across FET 110 and across FET 116 is negative so that no current flows through these FETs; during that time, however, the waveform of the signal D" provides a positive pulse across FET 112 and across FET 114 so that current flows through these FETs to produce a pulse between the source of FET 112 and the drain of FET 114, that is, in the signal G, but in the opposite direction compared to the direction of the pulse produced between the source of FET 110 and the drain of FET 116 caused by current flow through FET 110 and through FET 116 while a positive pulse from D' is applied across each of these two FETs. The resulting signal G constructed across the array 110–116 is a modified sinusoidal ac wave of the same frequency as the waveforms D' and D", and an amplitude equal to the voltage level of the dc/dc converter output F. A sample of the signal G is illustrated in FIG. 3, corresponding to the cycles of the signals C, D, D', D" and F.

When the signal G is applied to a loudspeaker driver, the inductance of the loudspeaker driver is added to the circuit of the switching coupler 18. This inductance tends to produce an inverse, or feedback, voltage to prevent the voltage level of the signal G from changing in amplitude every half cycle. However, the diodes 118–124 serve as clamping diodes to prevent electrical short circuits across the respective FETs during the dead times for each FET in the waveforms D' and D", and thus prevent the construction of back currents that would otherwise be generated by the feedback inductance of the loudspeaker driver.

The signal G can thus be communicated to a loudspeaker driver of any impedance since the connection from the power amplifier 50 of FIG. 2, for example, is indirect, through the four FETs 110–116 rather than directly through a transformer whose impedance would have to be selected to obtain a match with the impedance of the loudspeaker driver. Further, the power amplifier of the present invention can be readily adjusted in duty cycle, delay time, signal frequency and signal amplitude to match the requirements of virtually any loudspeaker driver, and in virtually any application, rendering the present invention a universal acoustic power amplifier.

Figure 4:
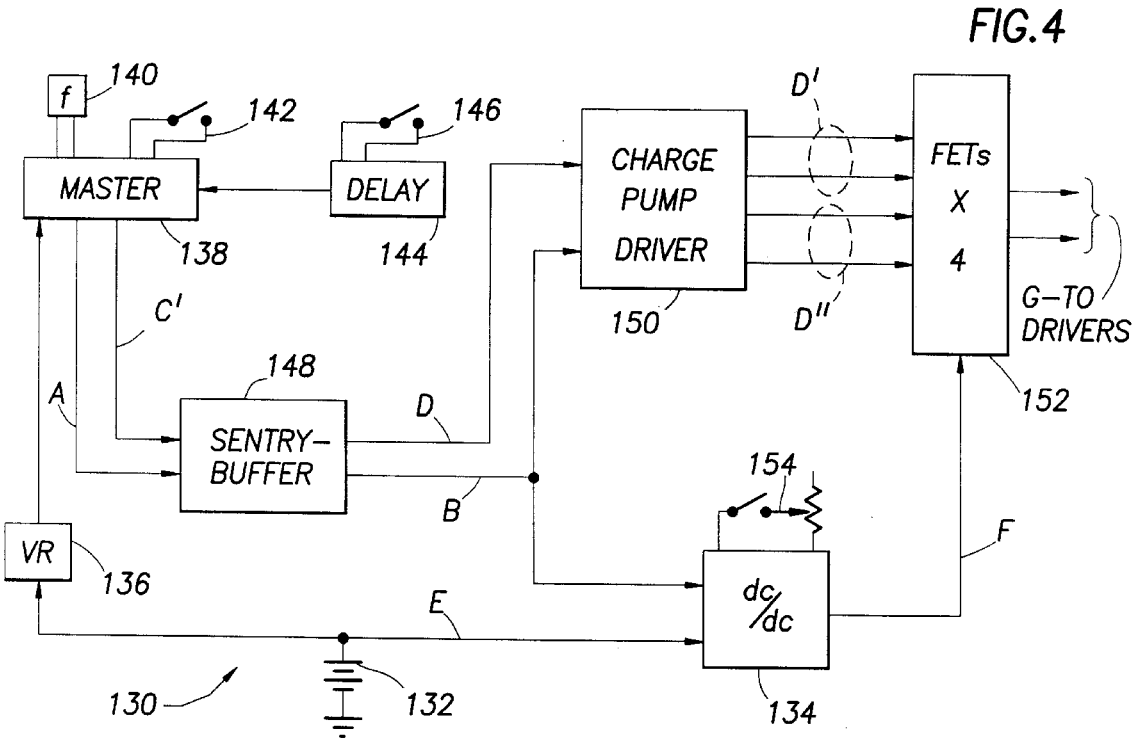
FIG. 4 is a block diagram of another version of a signal generator, or universal acoustic power amplifier, according to the present invention.

A block diagram of another embodiment of the signal generator, or power amplifier, according to the present invention is shown generally at 130 in FIG. 4. A dc power source 132 provides an appropriate power voltage level E to a voltage source circuit 134, which may comprise a dc/dc converter. A voltage regulator 136 steps the voltage level E to operate a master circuit 138, which may comprise an integrated circuit, such as an EPROM.

The master timing circuit 138 provides a pulsed duty cycle signal such as A in FIG. 3, and also produces a waveform signal C', which is similar to the waveform C in FIG. 3, but which is not pulsed according to the duty cycle A. The frequency of the waveform C' generated by the master circuit 138 is determined by use of a hex switch 140, connected to the master circuit. The duty cycle signal A from the master circuit 138 comprises a pulse train which determines when the signal generator 130 is "on", and generating an output signal with an appropriate waveform to drive a foghorn or other device, and when the generator is "off", and no such output signal waveform is provided. The particular duty cycle pulse train pattern generated by the master circuit 138 is selected by use of a switching device 142. Thus, the switch 142 may be set so that the master circuit 138 produces a duty cycle comprising a series of pulses that are two seconds in length, separated by eighteen seconds of down time, that is, the U.S. standard duty cycle for marine navigational aids and warning signal devices, or the switch may be set to cycle the master circuit according to the International Morse "U" code, or in some other selected signal pattern, as discussed above.

A delay circuit 144, which may also be in the form of an integrated circuit, is provided for effectively turning off the duty cycle signal A from the master circuit 138 for a selected time period, as discussed above in relation to the signal generator 50 of FIG. 2. An activation switch 146 may be used to selectively activate the delay circuit 144 to so interrupt the duty cycle of the power amplifier 130.

The duty cycle signal A and the waveform signal C' output from the master circuit 138 are received by a sentry/buffer circuit 148, which may also comprise an integrated circuit. The sentry/buffer 148 utilizes the duty cycle signal A to provide an operational power signal such as B in FIG. 3, which is communicated to the voltage source 134. The operational power signal B provides a selected voltage level appropriate for operating the voltage source 134, with the voltage level maintained in pulses during the "on" periods as determined by the duty cycle A. Consequently, the voltage source 134 operates only during the "on" periods to produce an output voltage level such as F as shown in FIG. 3.

The sentry/buffer 148 also amplifies the waveform C' provided by the master circuit 138, and pulses the signal according to the duty cycle signal A to provide the output signal D in FIG. 4. The signal D thus comprises a pulse train determined by the duty cycle A, containing within each pulse a waveform of the frequency determined by the master circuit 138 in conjunction with the hex switch 140, and with an amplitude determined by the sentry/buffer circuit 148. Thus, the pulsed and amplified waveform D of FIG. 4 appears generally as the signal D shown in FIG. 3. Further, the sentry/buffer 148 interrupts the waveform pattern according to the duty cycle "off" periods, thereby conserving energy in the operation of the generator 130.

The pulsed waveform D and the operational power signal B output from the sentry/buffer 148 are both received by a charge pump driver 150, which comprises an integrated circuit. The operational power signal B provides the voltage to operate the charge pump 150 during the "on" pulses of the duty cycle signal A to conserve energy. The charge pump driver 150 converts the waveform signal D input thereto to two driver signals, such as D' and D", as shown in FIG. 3, with D' being the inversion of D". The driver signals D' and D" are communicated to a coupler circuit 152 comprising an array of four FETs, such as the array of FETs and diodes 110–124 illustrated as part of the signal generator 50 in FIG. 2. The charge pump driver 150 is an integrated circuit which effectively performs the function of the transformers 86–92, resistors 94–100, and Zener diodes 102–108 of the signal generator 50 of FIG. 2, that is, dividing the signal D by providing two pulsed, shaped signals D' and D", one an inversion of the other. The frequency of the shaped signals D' and D" is the frequency determined at the master circuit 138, and the pulses are the pulses of the duty cycle A determined by the master circuit.

The coupler circuit 152 receives the voltage level signal F output from the voltage source 134, wherein the value of the voltage level F is selected using a voltage adjust 154, such as a variable resistor and switch. The voltage level signal F is applied across the FET array in the coupler circuit 152 as discussed above in relation to the signal generator 50 of FIG. 2, and the coupler circuit switches between the signals D' and D" to produce the output driver signal G, such as shown in FIG. 3, whose amplitude is determined by the value of the voltage level F. The coupler circuit 152 operates only during the "on" pulses of the duty cycle, as conveyed to this circuit by the pulsed power signal F, again to conserve energy in the operation of the signal generator 130.

The signal generator 130 may be considered an improvement over the signal generator 50 by encompassing a waveform generator within the master circuit 138, and providing an integrated circuit charge pump driver 150 to replace four separate transformers. Additionally, a single integrated circuit may be used to provide the master circuit 138, the delay circuit 144, and the sentry/buffer circuit 148.

The foregoing disclosure and description of the invention is illustrative and explanatory thereof, and various changes in the method steps as well as the details of the apparatus may be made within the scope of the appended claims without departing from the spirit of the invention.

What is claimed is:

1. An electrical signal generator comprising:

a. a timing circuit that produces a duty cycle signal defining a selected duty cycle by pulses;

b. a power sentry circuit that receives the duty cycle signal and provides a pulsed power signal including a voltage level for operating other circuits of the signal generator during the pulses of the duty cycle signal;

c. waveform generator circuitry that generates a waveform signal of selected frequency responsive to the pulsed power signal;

d. a voltage source circuit that receives and is operated by the pulsed power signal and provides a voltage level output signal during pulses of the duty cycle signal;

e. a coupler circuit that receives the waveform signal and the voltage level output signal, and, during the pulses of the duty cycle signal, provides an output driver signal with a waveform of the selected frequency and an amplitude determined by the voltage level of the voltage level output signal.

2. A signal generator as defined in claim 1 wherein the waveform generator circuitry comprises a circuit that receives and is operated by the pulsed power signal to so generate a waveform signal during the pulses of the duty cycle signal.

3. A signal generator as defined in claim 2 further comprising a signal driver circuit that receives the waveform signal from the waveform generator circuitry, and receives and is operated by the pulsed power signal, and amplifies the waveform signal during pulses of the duty cycle signal before the waveform signal is received by the coupler circuit.

4. A signal generator as defined in claim 3 wherein the signal driver circuit comprises an integrated circuit.

5. A signal generator as defined in claim 1 further comprising delay circuitry as part of the timing circuit whereby a selected delay period may be included in the duty cycle signal during which no pulses occur in the duty cycle signal.

6. A signal generator as defined in claim 1 wherein the timing circuit is adjustable between at least two configurations wherein a different duty cycle is defined for the duty cycle signal by each of the configurations.

7. A signal generator as defined in claim 1 wherein the timing circuit comprises an integrated circuit.

8. A signal generator as defined in claim 1 further comprising an integrated circuit that includes the timing circuit and the waveform generator circuitry.

9. A signal generator as defined in claim 1 wherein the power sentry circuit comprises an integrated circuit.

10. A signal generator as defined in claim 1 wherein the waveform generator circuitry is selectively variable to determine the frequency of the waveform signal generated by the waveform generator circuitry.

11. A signal generator as defined in claim 10 wherein the waveform generator circuitry comprises an integrated circuit.

12. A signal generator as defined in claim 1 wherein the voltage source circuit is selectively variable to determine the voltage level of the voltage level output signal provided by the voltage source circuit.

13. A signal generator as defined in claim 12 wherein the voltage source circuit comprises a dc/dc converter.

14. A signal generator as defined in claim 1 wherein:

a. the coupler circuit comprises an array of four field-effect transistors, with the drain of a first such transistor connected to the drain of a second such transistor, the source of a third such transistor connected to the source of a fourth such transistor, the source of the first transistor connected to the drain of the third transistor, the source of the second transistor connected to the drain of the fourth transistor, and wherein the output driver signal is provided at the source of the first transistor connected to the drain of the third transistor, and the source of the second transistor connected to the drain of the fourth transistor;

b. the voltage source circuit is connected across the first and third transistors in series, and across the second and fourth transistors in series, with the first and third transistors combined in parallel with the second and fourth transistors, to so apply the voltage level output signal to the array of transistors; and c. the input to each of the four transistors is across its respective gate and source.

15. A signal generator as defined in claim 14 further comprising a signal divider, as part of the coupler circuit, that divides the waveform signal received by the coupler circuit into a clipped waveform that is input across the first and fourth field-effect transistors, and an inverse clipped waveform that is input across the second and third field-effect transistors.

16. A signal generator as defined in claim 15 wherein the signal divider comprises:

a. four transformers having their primary coils connected in parallel to receive the waveform signal, with the secondary coil of a first such transformer connected across the gate and the source of the first field-effect transistor and the secondary coil of a second such transformer connected across the gate and the source of the fourth field-effect transistor, and with the secondary coil of a third such transformer connected across the gate and the source of the second field-effect transistor and the secondary coil of a fourth such transformer connected across the gate and the source of the third field-effect transistor, the output signals across the secondary coils of the third and fourth transformers being inverted compared to the output signals across the secondary coils of the first and second transformers; and b. a Zener diode across the secondary coil of each of the four transformers to clip the waveform signal produced at each transformer secondary coil.

17. A signal generator as defined in claim 15 wherein the signal divider comprises a charge pump driver.

18. A method of generating an electric waveform driver signal for exciting the driver of an acoustic emitter comprising the following steps:

a. producing an electrical duty cycle signal defined by pulses;

b. producing a waveform signal of selected frequency responsive to the electrical duty cycle signal;

c. producing a power signal including an operating voltage level during pulses of the duty cycle signal; and d. dividing and shaping the waveform signal, and applying the shaped waveform signal to a pair of field-effect transistors while applying an inversion of the shaped waveform signal to another pair of field-effect transistors to produce the output electric waveform driver signal across the two pairs of field-effect transistors.

19. A method as defined in claim 18 further comprising the steps of pulsing the waveform signal according to the duty cycle signal, and amplifying the waveform signal, before it is divided and shaped.

20. A method as defined in claim 19 wherein the steps of generating the waveform signal, and of pulsing and amplifying the waveform signal, are performed using at least one integrated circuit.

21. A method as defined in claim 18 further comprising selectively varying the amplitude of the duty cycle signal pulses.

22. A method as defined in claim 18 further comprising selectively varying the frequency of the waveform signal.

23. A method as defined in claim 18 further comprising using the power signal to provide a voltage level signal during pulses of the duty cycle signal to operate the field-effect transistors.

24. A method as defined in claim 23 further comprising selectively varying the voltage level of the voltage level signal.

25. A method as defined in claim 23 wherein the step of providing a voltage level signal is performed using an integrated circuit.

26. A method as defined in claim 18 wherein the step of producing an electrical duty cycle signal is performed using an integrated circuit.

27. A method as defined in claim 18 wherein the step of producing a power signal is performed using an integrated circuit.

28. A method as defined in claim 18 wherein the step of dividing the waveform signal is performed using transformers.

29. A method as defined in claim 18 wherein the step of dividing the waveform signal is performed using a charge pump driver.

30. A method as defined in claim 18 wherein the step of shaping the waveform signal is performed using Zener diodes.

31. A method as defined in claim 18 wherein the steps of producing an electrical duty cycle signal and of producing a waveform signal are performed, at least in part, using an integrated circuit.

32. A universal power amplifier for generating amplified electrical waveform signals for driving acoustical devices, comprising:

a. a timing circuit that provides a duty cycle signal including pulses that determine the periods of time during which waveform signals are to be output by the universal power amplifier;

b. a power sentry circuit that receives the duty cycle signal and provides a pulsed power signal with a voltage level for operating other circuits of the universal power amplifier during pulses of the duty cycle signal;

c. waveform generator circuitry that provides a waveform signal of selected frequency responsive to the pulsed power signal, and including a variable frequency selecting circuit;

d. a voltage source circuit that receives the pulsed power signal and provides a voltage level output signal during pulses of the duty cycle signal, and includes a variable voltage level selecting circuit;

e. a coupler circuit that receives the waveform signal and the voltage level output signal, and, during pulses of the duty cycle signal, provides an output driver signal having a waveform of the selected frequency and an amplitude determined by the selected voltage level of the voltage level output signal.

33. A universal power amplifier as defined in claim 32 further comprising a signal driver circuit that receives the waveform signal and the pulsed power signal, and amplifies the waveform signal during pulses of the duty cycle signal.

34. A universal power amplifier as defined in claim 32 further comprising delay circuitry as part of the timing circuit whereby a selected delay period may be included in the duty cycle signal.

35. A universal power amplifier as defined in claim 32 wherein the timing circuit, the power sentry circuit and the waveform generator circuitry comprise integrated circuits.

* * * * *